US008381948B1

(12) United States Patent
Jian et al.

(10) Patent No.: US 8,381,948 B1
(45) Date of Patent: Feb. 26, 2013

(54) AUTOMATIC LIQUID STOP BAG WITH BENT PORTION

(76) Inventors: Bo Xin Jian, New Taipei (TW); Yaw Shin Liao, New Taipei (TW)

( * ) Notice: Subject to any disclaimer, the term of this patent is extended or adjusted under 35 U.S.C. 154(b) by 45 days.

(21) Appl. No.: 13/225,562

(22) Filed: Sep. 6, 2011

(51) Int. Cl.
*B65D 35/00* (2006.01)

(52) U.S. Cl. ..... 222/107; 222/213; 222/491; 222/541.1; 383/44; 383/204; 383/906

(58) Field of Classification Search ..... 222/92, 222/107, 153.06, 206, 207, 212–215, 541.1, 222/491, 541.6, 494, 541.9, 566, 572, 574, 222/564; 383/44, 47, 105, 116, 204, 906, 383/33
See application file for complete search history.

(56) References Cited

U.S. PATENT DOCUMENTS 2,707,581 A * 5/1955 Kaplan et al. ..... 222/107
4,717,046 A * 1/1988 Brogli ..... 222/107
4,830,205 A * 5/1989 Hammond et al. ..... 215/11.3
4,974,732 A * 12/1990 Sullivan et al. ..... 222/541.6
4,988,016 A * 1/1991 Hawkins et al. ..... 222/92
5,005,734 A * 4/1991 Van Gordon et al. ..... 222/107
5,018,646 A * 5/1991 Billman et al. ..... 222/107
5,529,224 A * 6/1996 Chan et al. ..... 222/212
5,839,609 A * 11/1998 Zakensberg ..... 222/107
5,931,345 A * 8/1999 Lane et al. ..... 222/105
5,996,845 A * 12/1999 Chan ..... 222/107
6,209,754 B1 * 4/2001 Suzumi ..... 222/92
6,360,916 B1 * 3/2002 Sokolsky et al. ..... 222/107
6,667,081 B1 * 12/2003 Aoki et al. ..... 428/34.1
8,002,468 B2 * 8/2011 Otsuka et al. ..... 383/104
8,070,016 B2 * 12/2011 Kawakami et al. ..... 222/107

* cited by examiner

*Primary Examiner* — Frederick C. Nicolas

(57) ABSTRACT

An automatic liquid stop bag with a bending portion comprises: two outer films, two inner films, a storage area, a discharge channel, a bent portion, an inlet, an outlet and a tear portion. The storage area is formed by coupling the two outer films by hot sealing. The two inner films are disposed between the two outer films and coupled the two inner films by heat sealing to form a discharge channel or the discharge channel is coupled to the two inner films by heat sealing and formed between the two inner films, and the internal sides of the two inner films are not coupled to form the inlet and outlet, and the tear portion is formed at an edge of the two inner films and the two outer films and separated from the two inner films to expose the outlet of the discharge channel.

14 Claims, 13 Drawing Sheets

AUTOMATIC LIQUID STOP BAG WITH BENT PORTION

BACKGROUND OF THE INVENTION

1. Field of the Invention

The present invention relates to a liquid container structure, in particular to an automatic liquid stop bag with a bending portion.

2. Description of the Prior Art

Beverages, liquid food or cleaning supplies available in the market are generally contained in containers such as plastic bottles with a bottle cap. At present, the common plastic bottle structure is an integrally formed bottle having a bottle body 11 with an interior space for containing a liquid, a bottle mouth formed at the top of the bottle body for filling a liquid or inserting a straw to drink a beverage. Billions of plastic bottles or containers are used yearly, and the used plastic bottles or containers have tremendous impacts on environmental protection, particularly the transportation and recycle of the used empty bottles, and the follow-up treatment is very inconvenient.

To echo the issue of environmental protection, a flexible package bag structure was introduced, and the flexible package bag can contain liquid. When a user wants to drink or use the liquid, the user simply tear open the flexible package bag to form an opening for accessing the liquid inside the flexible package bag. However, such flexible package bag structure requires a zipper bag for re-sealing. The liquid will leak if the user seals the zipper bag improperly or forgets to seal the bag. Furthermore, the zipper bag does not have a flow top function, so that after the bag is torn open to form an opening, a careful storage is required. If the bag is toppled over, the liquid in the flexible package bag will leak from the opening and result in contamination and unnecessary waste. Obviously, such conventional bag structure is very inconvenient and requires improvements. As disclosed in U.S. Pat. No. 5,529,224 (filed on May 27, 1994), a self-closing liquid dispensing package is provided. The self-closing liquid dispensing package comprises a liquid container and a self-closing flat channel. The channel comprises an inlet formed adjacent to the liquid container and provided for flowing a liquid, a mouth, a first sheet member, and a second sheet member, wherein the first and second sheet members have an original planar position and longitudinal edges and are sufficiently flexible to arch away from each other to form a flow channel therebetween. At least one of said first and second sheet members is sufficiently resilient to return the first and second sheet members to their original planar position for a seal when the external pressure is released. The mouth has a lateral width greater than the lateral width of the inlet, and an additional portion is disposed between the inlet and the mouth which has a lateral width greater than said lateral width at said inlet and said lateral width at said mouth. This patented invention is characterized in that the first and second sheet members come with a specific elasticity; in other words, the first and second sheet members are made of an elastic material, thus incurring a more complicated manufacturing process and a higher level of difficulty of selecting the elastic material. If the self-closing liquid dispensing package is elastically fatigue, then there will be a possibility of leakage. On the other hand, if the self-closing liquid dispensing package has a too-large flexibility, then the liquid may not be able to squeeze out from the liquid dispensing package. Obviously, the conventional liquid dispensing package requires improvements.

SUMMARY OF THE INVENTION

Therefore, it is a primary objective of the present invention to provide an automatic liquid stop bag with a bending portion, comprising: two outer films containing two inner films with an equal width and a smaller length of the outer films and coupled to the two outer films respectively by heat sealing to form a filling area, a storage area, and a discharge area. The discharge area includes a discharge channel, at least one inlet, a bent portion and an outlet by heat sealing, and the discharge area and heat seal dotted lines of the two outer films forms a tear portion. A stop plate is installed or a heat resisting material is coated at the inlet and the outlet when the four films are heat sealed, such that the internal sides of the outer and inner films will not be coupled face-to-face, but each inner film is coupled to each corresponding outer film by heat sealing. The tear portion having the heat seal dotted lines and notches is disposed on a side of the two inner films. After the tear portion is separated from the two inner films, the outlet of the discharge channel will be exposed.

When the two outer films are squeezed by external forces, the pressure forces the liquid in the bag to rise, and the rising liquid will pull that section of the outer film outward to open the inlet of the discharge channel automatically, such that the liquid flows from the inlet of the discharge channel into the discharge channel and flows out from the outlet. After the external force is released, the reaction force for refluxing the liquid to the storage area produces a suction, and the discharge channel specifically comes with a bent portion for forming a flow stop effect, and a reaction force is formed or enhanced by a suction along a turning of bent portion, such that the two inner films are attached to one another to shut the discharge channel.

When the automatic liquid stop bag with a bending portion of the present invention is toppled over, there is no external pressure, so that the inlet of the discharge channel cannot be opened. In addition, the two inner films of the bent portion in the discharge channel are still attached with each other to shut the discharge channel closely, so that the liquid will not leak from the discharge channel. When use, a user simply needs to apply a force to squeeze the storage area, so that the two outer films will squeeze the liquid in the storage area liquid to rise to pull the non-stress area of the two outer films outward to naturally drive and pull the inlet of the two inner films open, so as to flow the liquid along the discharge channel to the outside by pressure.

The automatic liquid stop bag with a bending portion of the present invention achieves the effects of a simple and easily use, a reduction of wastes, protecting the environment, and automatically closing the bag since the invention no longer needs to have a traditional rotating cap or use a hand to press and control the liquid flow. When the bag is toppled over, the liquid will not flow out. The present invention just needs two inner films and two outer films to achieve the effects of the conventional liquid bottle and its rotating cap, not only lowering the manufacturing cost and providing a convenient use, but also not occupying much space, saving the material cost and reducing wastes since only two films are used. Obviously, the automatic liquid stop bag with a bending portion of the present invention automatic liquid stop bag with a bending portion of the present invention is the best solution of substituting the traditional liquid package.

The invention is characterized in that when an external force is exerted onto the storage area to force the liquid to rise, such that the two outer films are pulled outward by the liquid to automatically open the inlet of the discharge guide channel, and the liquid flows towards the outlet along the bent portion of the discharge channel. When the pressure is released, the reaction suction for returning the liquid back to the storage area drives the two inner films of the bent portion of the discharge channel to be attached with one another by the reaction force to close the discharge channel, wherein when the external force is released, the liquid returns from the bent portion to the storage area instantaneously, a reaction force is produce to achieve the effect of sealing the discharge channel. In addition, the two inner films at the bent portion are attached with each other to enhance the effect of sealing the discharge channel.

DETAILED DESCRIPTION OF THE PREFERRED EMBODIMENTS

Figure 1A:
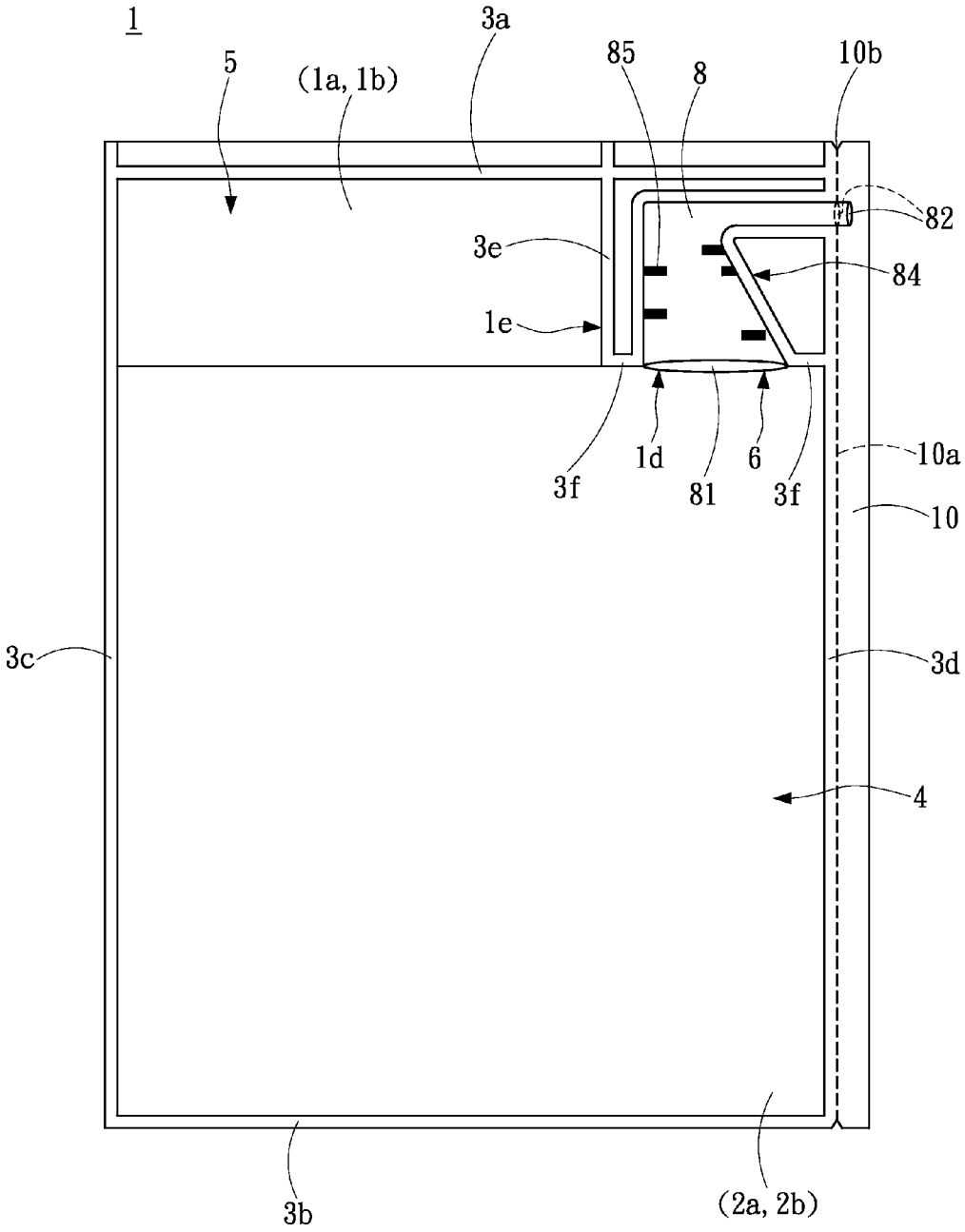
FIG. 1A is a schematic view of a first preferred embodiment of the present invention.
Figure 2A:
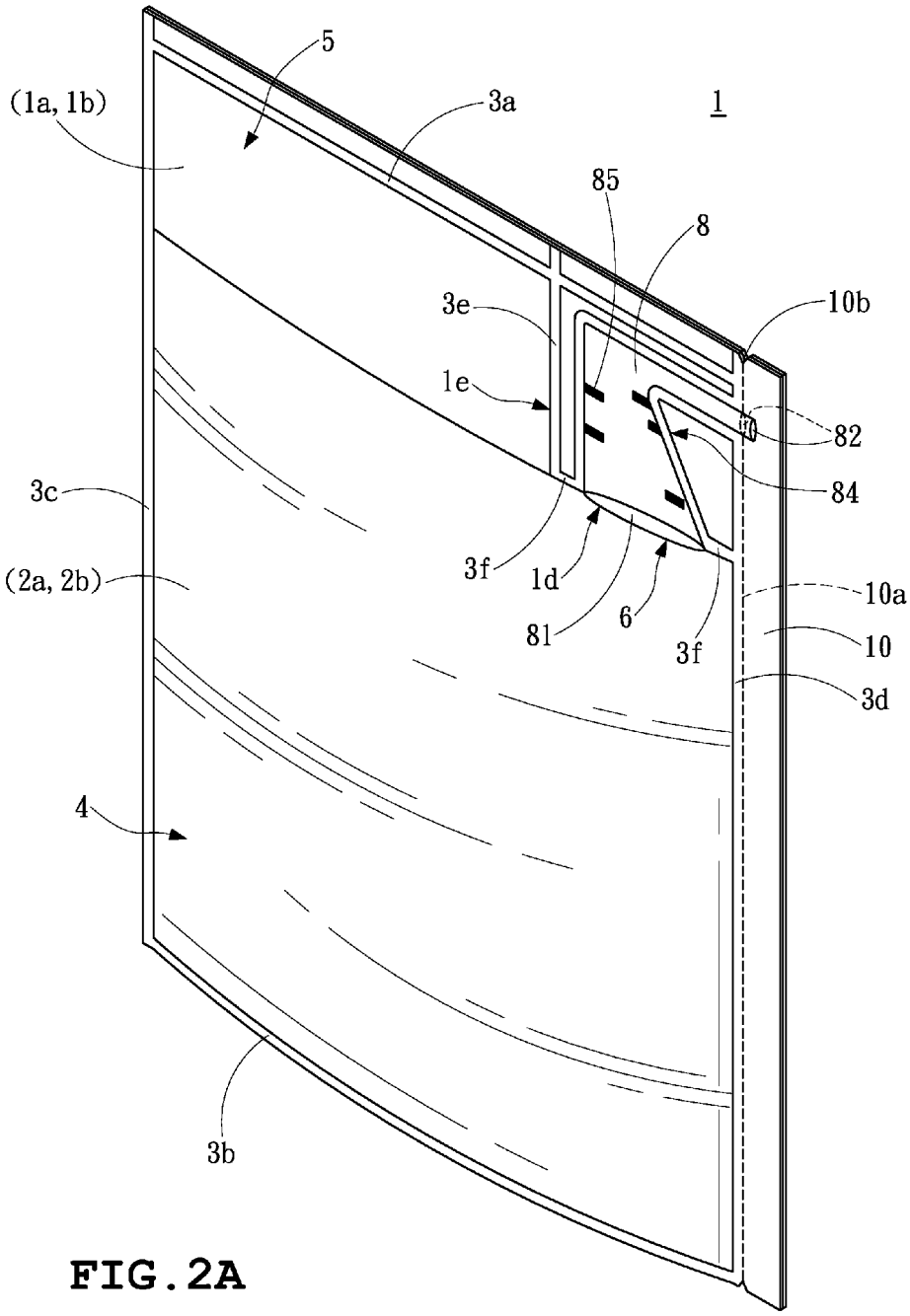
FIG. 2A is a schematic view of the first preferred embodiment of the present invention before the bag structure is torn open.
Figure 2B:
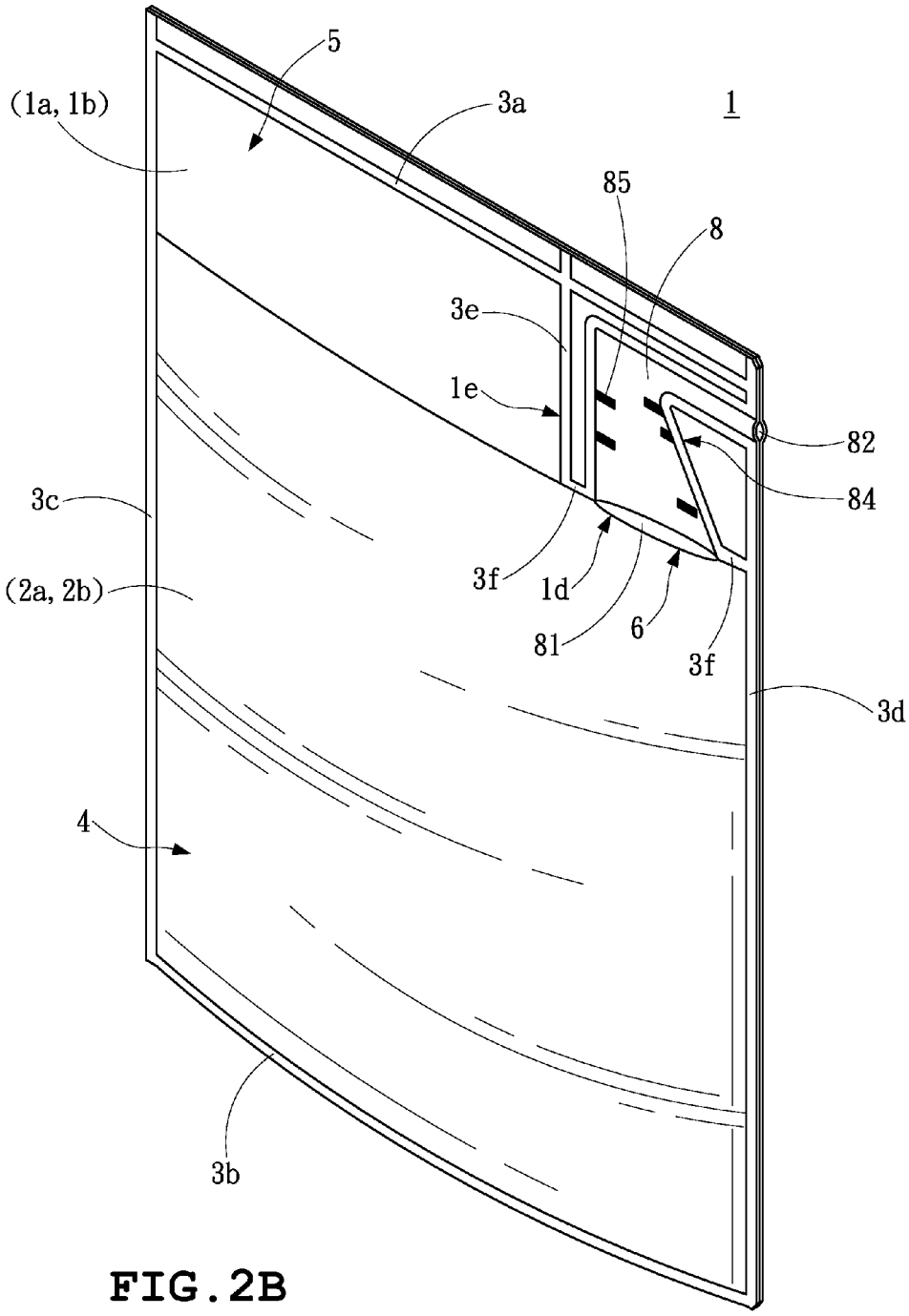
FIG. 2B is a schematic view of the first preferred embodiment of the present invention after the bag structure is torn open.
Figure 2C:
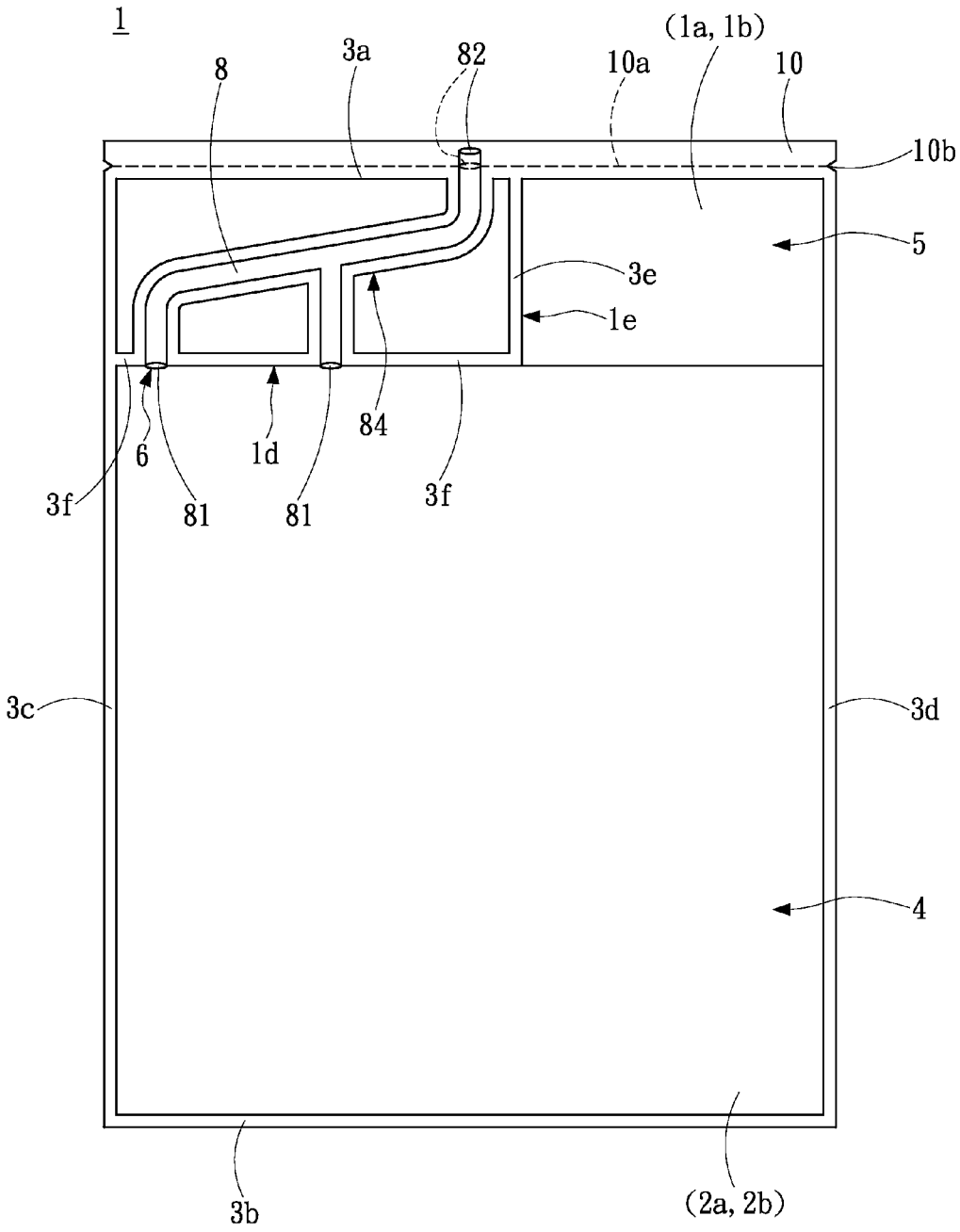
FIG. 2C is a schematic view of another implementation of the first preferred embodiment of the present invention.
Figure 2D:
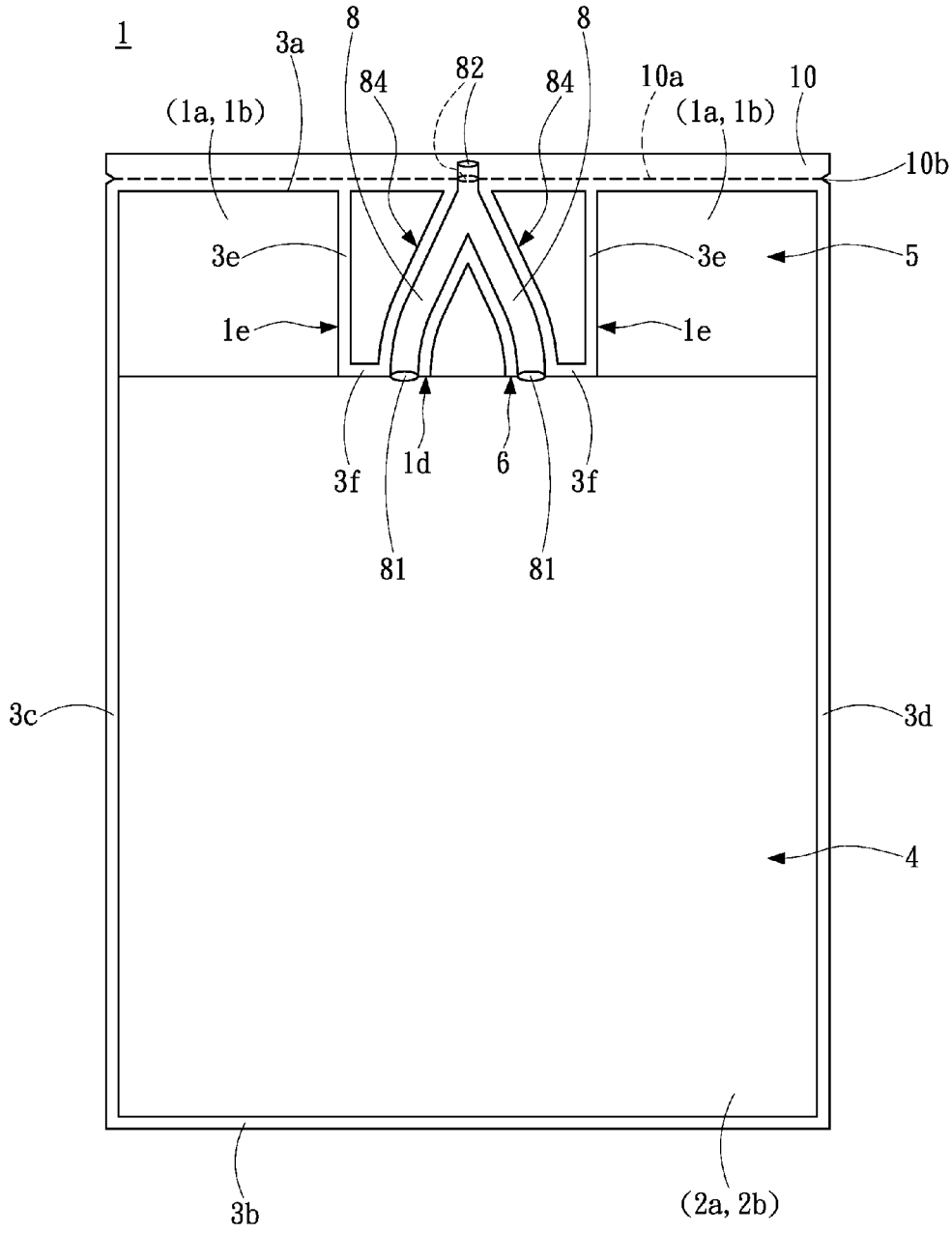
FIG. 2D is a schematic view of another implementation of the first preferred embodiment of the present invention.

With reference to FIGS. 1A, 2A and 2B for an automatic liquid stop bag with a bending portion in accordance with the first preferred embodiment of the present invention, the two inner films are installed horizontally. With reference to FIGS. 2C and 2D for a first preferred embodiment of the present invention, the two inner films are installed horizontally in another implementation.

The automatic liquid stop bag with a bending portion 1 of the present invention comprises: two outer films 2*a*, 2*b*, two inner films 1*a*, 1*b*, a storage area 4, a filling area 5, a discharge area 6, a discharge channel 8, and a tear portion 10.

The two outer films 2*a*, 2*b* are stacked on top of one another, and thermally sealed to form a bag.

The storage area 4 is coupled to the two outer films 2*a*, 2*b* by heat sealing, formed between the two outer films 2*a*, 2*b*, and provided for storing a liquid 9, wherein the storage area 4 is formed within the heat-sealed lines 3*b*, 3*c*, 3*d* by heat sealing.

Figure 1B:
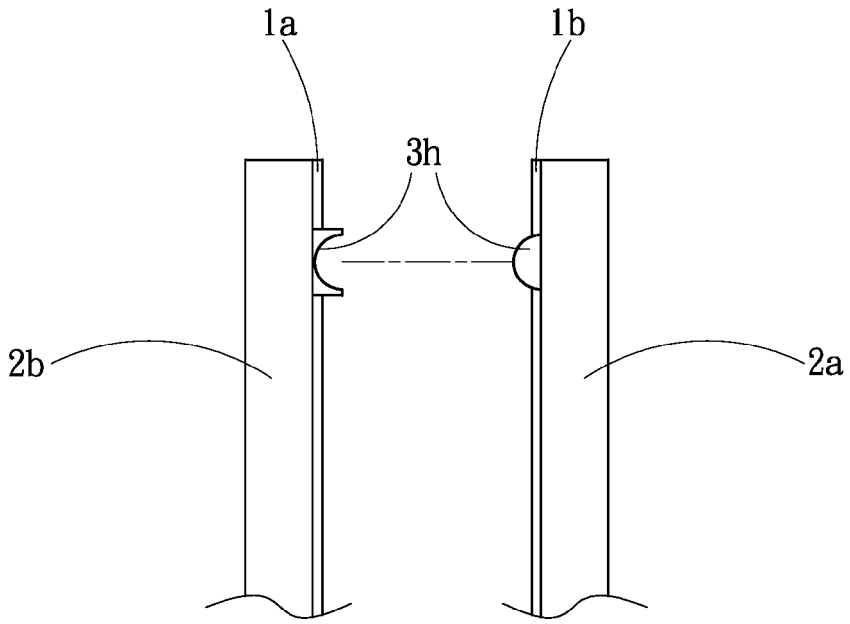
FIG. 1B is a schematic view of a clip chain of the first preferred embodiment of the present invention.

The filling area 5 is situated between the two outer films 2*a*, 2*b* and formed on a side of the storage area 4*e* by the heat-seal lines 3*c*, 3*b*, 3*d* for filling the liquid 9 into the storage area 4. After the liquid 9 is filled into the storage area 4, the two outer films 2*a*, 2*b* are coupled by a sealing element to seal the filling area 5. The sealing element is preferably the heat-sealed line 3*a* formed by heat sealing, but the present invention is not limited to such arrangement only, but the sealing element can be a clip chain 3*h* as shown in FIG. 1B, such that after a user fills the liquid 9, the user can seal the bag with the clip chain 3*h*. For pouring the liquid 9 out from the sealed bag, the heat-sealed line 3*f* is designed at the same height of an inlet 81, such that the rinsing level of the liquid caused by the pressure will not go beyond a level higher than the inlet 81 of the discharge channel 8, and the liquid will not flow from the inlet 81 of the discharge channel 8 to an outlet 82.

The discharge area 6 is formed between the two outer films 2*a*, 2*b* and disposed on a side of storage area 4, wherein the discharge area 6 and the filling area 5 are preferably separated by the heat-sealed line 3*e*.

The two inner films 1*a*, 1*b* are situated between the two outer films 2*a*, 2*b*, and the two outer films 2*a*, 2*b* are arranged horizontally and installed in the discharge area 6. In this preferred embodiment, the width of the two inner films 1*a*, 1*b* are the same, but the length of the two inner films 1*a*, 1*b* is shorter than the length of the two outer films 2*a*, 2*b*, such that both left and right sides of the two inner films 1*a*, 1*b* are aligned evenly with the top end of the two outer films 2*a*, 2*b*, and a side of the two inner films 1*a*, 1*b* is protruded from the discharge area 6, and a side of the two inner films 1*a*, 1*b* is situated in the filling area 5. However, structure of the present invention is not limited to such arrangement only.

The discharge area 6 is defined by enclosing two inner films 1*a*, 1*b* into the two outer films 2*a*, 2*b* to form the discharge channel 8 by heat sealing, and the discharge channel 8 is comprised of the inlet 81, the bent portion 84, and the outlet 82. There are three hot sealing methods, respectively: (1) Two inner films 1*a*, 1*b* are independently and thermally sealed to form the bent portion 84, and then the two inner films 1*a*, 1*b* and the two outer films 2*a*, 2*ba* are provided for thermally sealing the boundary of the filling area 5 and the discharge area 6, the outlet and the inlet. (2) Two inner films 1*a*, 1*b* and one outer film 2*a* or 2*b* are thermally sealed to form the bent portion 84, and the two inner films 1*a*, 1*b*, and the outer film 2*a* or 2*b* are used for thermally sealing the filling area 5, the boundary of the discharge area 6, the outlet and the inlet. (3) Two inner films 1*a*, 1*b* and two outer films 2*a*, 2*ba* are thermally sealed to form (a) the boundary of the filling area 5 and the discharge area 6; (b) the inlet 81, the bent portion 84 and the outlet 82 of the discharge channel 8. These three methods aims enhancing the two inner films la, 1 in the bent portion 84, such that when the liquid returns into the storage area 4, a reaction force is produced to drive the two inner films 1*a*, 1*b* to attach with one another, wherein the magnitude of the adhesive force depends on the attaching space. In method (1), the two inner films 1*a*, 1*b* of the bent portion 84 are not combined with the two outer films 2*a*, 2*b*, so that a larger moving space is provided to give a greater adhesive force.

The inlet 81 and the outlet 82 of the discharge channel 8 are thermally sealed by the following heat sealing method:

A heat resisting material is pre-coated at predetermined positions of the inlet 81 and the outlet 82 or a stop plate is installed at a predetermined position for thermally sealing the two outer films 2*a*, 2*b* and the two inner films la, 1*b* with the outlet 82 and the inlet 81, such that internal sides of the two inner films 1*a*, 1*b* are not coupled during the hot sealing process, but the external side of each of the two inner films 1*a*, 1*b* is coupled to each of the corresponding two outer films 2*a*, 2*b* to outwardly extend the outer film 2*a*, 2*b* by the pressure, such that each of the corresponding outer films 2*a*, 2*b* is coupled to each of the corresponding inner films la, 1*b* to pull the non-coupled positions at internal surfaces of the two inner films 1*a*, 1*b*, so as to form the inlet 81 and the outlet 82.

Since there is at least one bent portion 84 in the discharge channel 8 and the bent portion 84 is S-shaped, corner-turning shaped, arc shaped, lightning shaped, or W-shaped. The bent portion 84 is provided for overcoming the resistance against the suction at the corner-turning position, and intangibly enhancing the mutual adhesion effect of the two inner films 1*a*, 1*b* at the bent portion 84 to provide an automatic flow stop effect. In addition, a railing 85 can be installed in the bent portion 84 and used as a hydraulic throttle when the liquid has no pressure for improving the sealing effect. Further, a tear portion 10 is provided at the position of the outer film of the outlet 82 by pre-sealing the dotted lines of the tearing line 10*a* and the tearing notch 10*b*. After the automatic liquid stop bag with a bending portion is filled with liquid and sealed, a completely sealed liquid storage bag is produced. When use, the tearing notch 10*b* is torn to expose the outlet 82 of the two inner films discharge channel 8, and a pressure is applied onto the bag, such that the pressure drives the level of the liquid 9 to rise and the two outer films to expand outward to naturally pull open the inlet 81 of the discharge channel 8, and the liquid flows along the inlet 81 of the discharge channel 8 through the bent portion 84, and discharges from the outlet 82. When the external pressure is released, the liquid 9 returns from the bent portion 84 to the storage area 4 instantaneously. The return produces a reaction force to drive the two inner films 1*a*, 1*b* of the discharge channel 8 to attach with one another by suction, so as to achieve the effect of sealing the discharge channel 8. Since there is the bent portion 84, the two inner films 1*a*, 1*b* at the bent portion 84 will be attached with one another more securely to improve the sealing effect. If the automatic liquid stop bag with a bending portion is toppled over, there is no external force, so that the liquid 9 is unable to pull open two outer films 2*a*, 2*b* by itself, and the inlet 81 of the discharge channel 8 cannot be opened. As a result, the liquid of the toppled liquid 9 will not flow out from the bag, and the automatic liquid stop bag with a bending portion has advantages on its application.

In another implementation of the automatic liquid stop bag with a bending portion in accordance with the first preferred embodiment of the present invention, two inner films are installed horizontally, and a plurality of inlets is provided.

In the first preferred embodiment, the two inner films 1*a*, 1*b* are included horizontally in the two outer films 2*a*, 2*b*, and the storage area 4, the filling area 5 and the discharge area 6 are formed by heat sealing, and the discharge area 6 includes a discharge channel 8 with a dual inlet 81, at least one bent portion 84 and a tear portion 10. The outlet 81 of the discharge channel 8 can be installed at an edge or in the middle. In this embodiment, the outlet 81 is arranged at the middle of the discharge channel 8, and the tear portion 10 can be designed at the upper section of the discharge channel as shown in FIGS. 2C and 2D.

Figure 4:
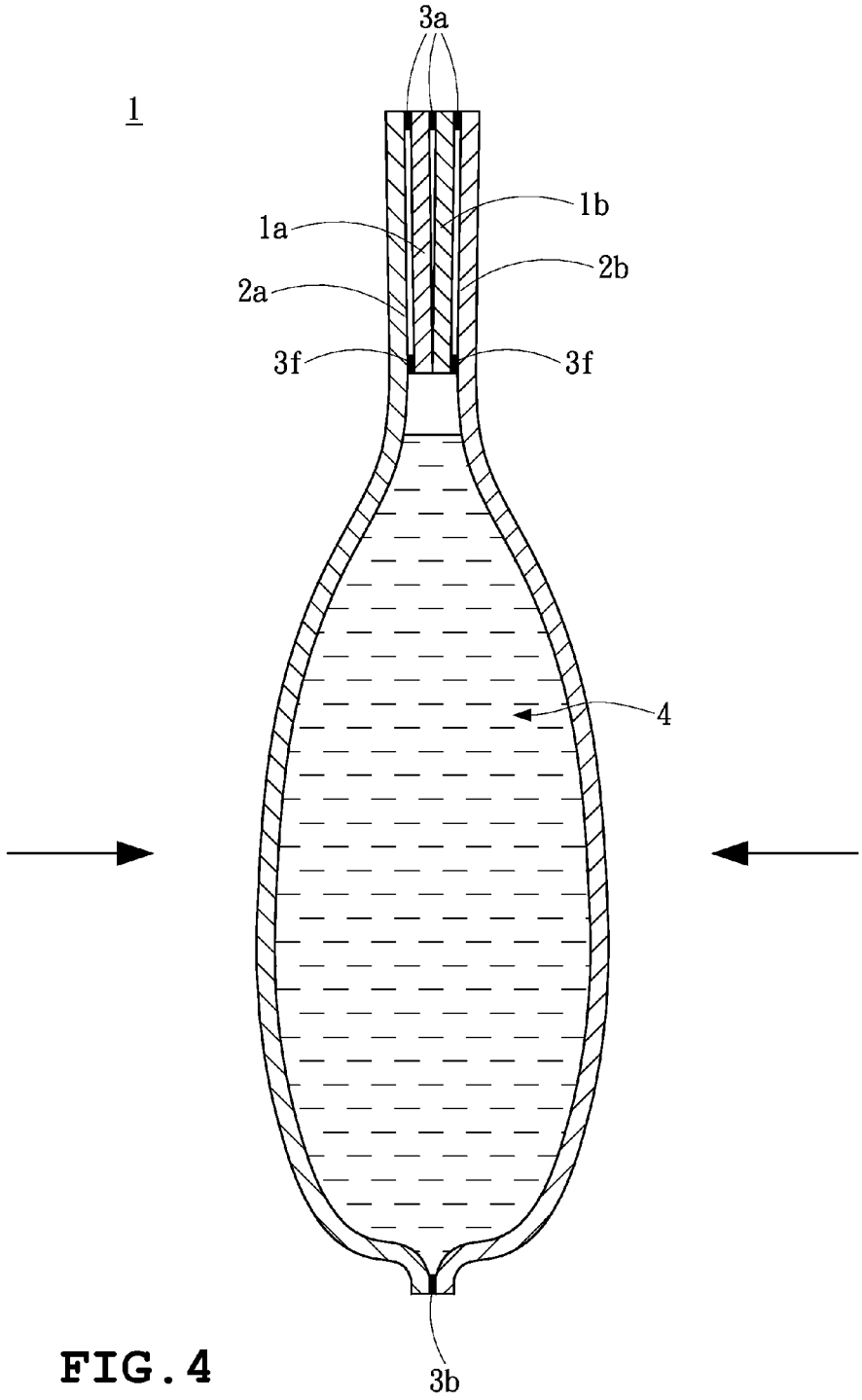
FIG. 4 is a schematic view of the second preferred embodiment of the present invention before the inlet is opened.
Figure 5:
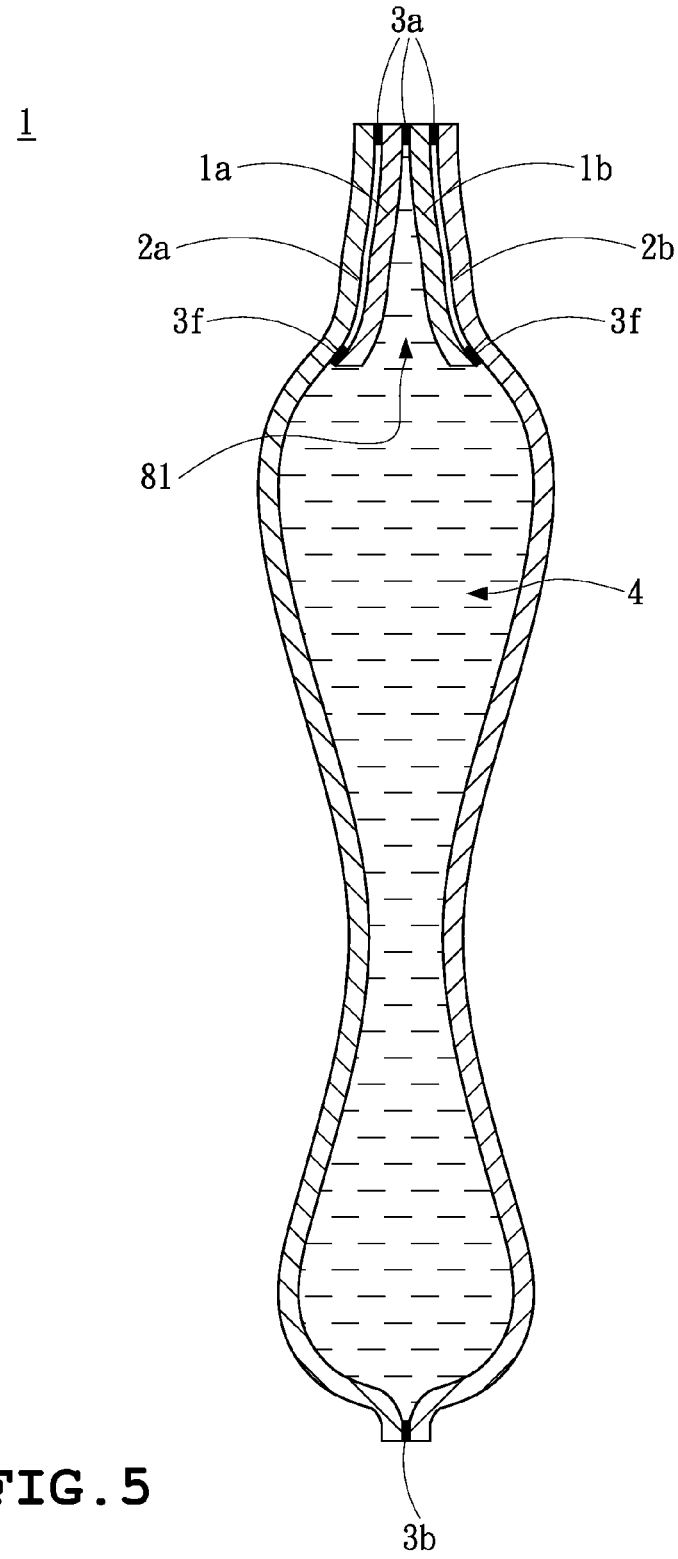
FIG. 5 is a schematic view of the second preferred embodiment of the present invention after the inlet is opened.

After the liquid 9 flows from the filling area 5 into the storage area 4, the filling area 5 is sealed by a sealing element. In FIGS. 4A and 4B, a force is applied to squeeze the two outer films 2*a*, 2*b* of the storage area 4 to force the liquid 9 to flow towards a first side ld of the two inner films 1*a*, 1*b*, the two outer films 2*a*, 2*b* on the first side ld are pulled open by the outwardly pulled outer films 2*a*, 2*b* to open the inlet 81 of the discharge channel 8 automatically, so that the liquid 9 can flow from the inlet 81 into the discharge channel 8, and then along the bent portion of the discharge channel 8 and through the outlet 82 to the outside.

Figure 3A:
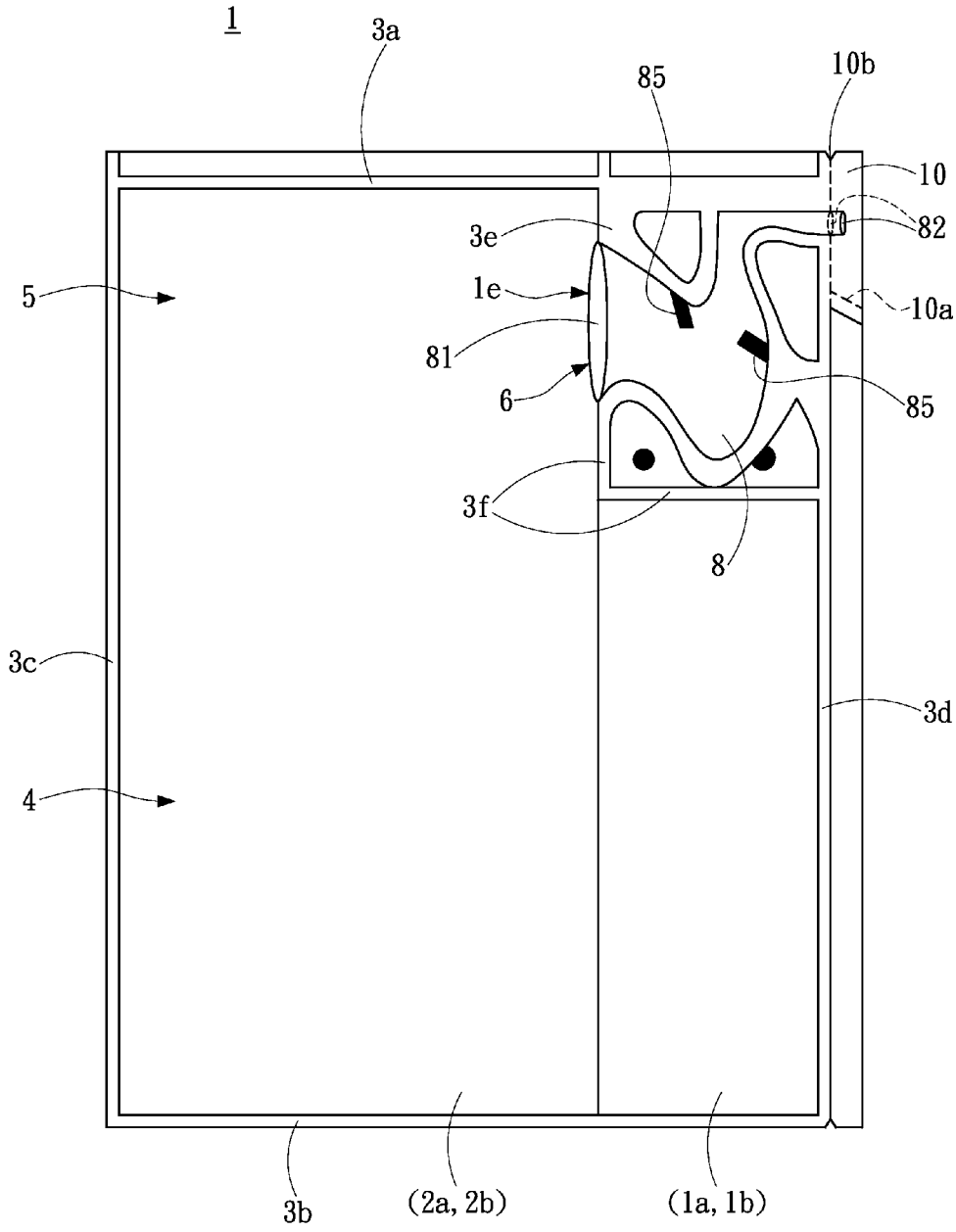
FIG. 3A is a schematic view of a second preferred embodiment of the present invention.

With reference to FIG. 3A for the second preferred embodiment of the present invention, the inner films are vertically installed flow stop structure.

Two narrow inner films are installed vertically on a side in the two outer films, and upper sections of the four films are thermally sealed at the same time, and the heat-sealed lines 3*b*, 3*c*, 3*d*, 3*f* are provided to form a bag 1 for containing liquid, and divide the bag 1 into the filling area 5, the discharge area 8, the storage area 4, and the heat-sealed line 3*e*. The discharge channel is formed in the discharge area and comprises an inlet 81, a bent portion 84 and an outlet 82. When the inlet 81 and the outlet 82 are being thermally sealed, a stop plate is applied to the internal surfaces of the two inner films 1*a*, 1*b* or a heat sealing resisting material is pre-coated, such that the internal surfaces of the two inner films 1*a*, 1*b* are not coupled with one another during the hot sealing process, but each of the two inner films 1*a*, 1*b* and its corresponding outer films 2*a*, 2*b* are thermally sealed. In the meantime, the tearing line 10*a* and the notch 10*b* at the tear portion and at an outer film of the outlet 82 can be torn. The filling area 3*a* can be thermally sealed to produce a totally sealed liquid bag after the liquid is filled. For a convenient use, the tearing opening 10*b* can be torn to expose the outlet 82. To enhance the effect of preventing the stored liquid from flowing out when the bag is toppled over, a railing 85 is designed at the hot-sealing section of the bent portion 84 of the discharge channel, so as to achieve the enhanced flow stop effect. In the vertical two inner films 1*a*, 1*b*, the discharge area 6 can be designed at the middle section on a side of the four films 1*a*, 1*b*, 2*a*, 2*ba*, wherein the structure of the discharge area is also arranged at the upper section to provide the discharge channel, at least one inlet 81, the bent portion 84, the outlet 82 and the pre-set tear portion 10.

Figure 3B:
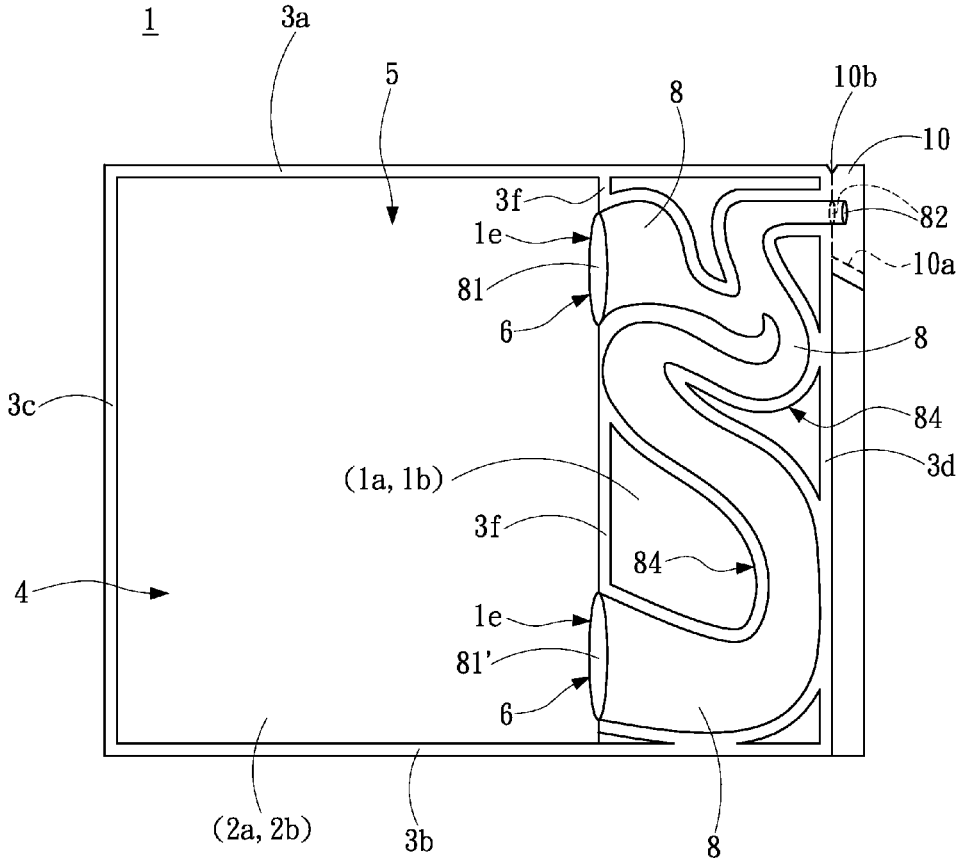
FIG. 3B is a schematic view of another implementation of the second preferred embodiment of the present invention.

With reference to FIG. 3B for another implementation of the second preferred embodiment of the present invention, a dual inlet and a discharge channel with a multiple of bent portions are provided.

The present invention also provides a vertical flow stop structure with a dual inlet to improve the speed of the liquid flowing out from the bag. In other words, the two perpendicular inner films are installed on a side inside the two outer films, and the heat-seal lines 3*c*, 3*b*, 3*d*, 3*f* are sealed to form the liquid bag 1 for containing liquid, the filling area 5, the storage area 4, and the discharge area 6, a heat resisting material is coated at the position of the inlet and the outlet formed on the internal side of the two inner films or a stop plate is applied during the hot sealing process, such that the internal surfaces of the inner films in such area will not attach with one another during the hot sealing process, but the heat-sealed line 3*f* of the inner film is sealed to form a dual inlet (including an upper inlet 81 and a lower inlet 81') and a discharge channel 84. The discharge channel includes a plurality of bent portions, and combined into an outlet 82, and the heat-sealed line 10*a* and the tearing notch 10*b* of the outlet at the predetermined positions of the two outer films can be torn open. After the liquid bag is filled with liquid, the hot-seal line 3*a* is thermally sealed to form a totally sealed space. In practical applications, the notch 10*b* is torn open directly to expose the outlet 82 of the two inner films 1*a*, 1*b*, and a pressure is applied to the two outer films, such that the level of the liquid rises, and the outer films are not pressed by the pressure or opened, since the outer films at the position of the inlet of the inner films are coupled. Therefore, the inlet 82 is pulled open naturally, and the liquid 9 will flow towards the outlet 82 of the discharge channel 8. After the pressure is released, the liquid 9 returns to the discharge channel 8 to produce a reaction force to drive the two inner films 1*a*, 1*b* of the discharge channel 8 to attach with one another and achieve the sealing and stop flow effects.

To control the level of the liquid in the bag not higher than the heat-sealed line 3*f* or having no pressure at the filling section when the liquid bag 1 is squeezed, a hot-seal line 3*a* can be added at a height equal to the heat-sealed line 3*f* after the filling is completed, such that the level of the liquid will not exceed the inlet of the discharge channel to optimize the condition of discharging the liquid.

Figure 6:
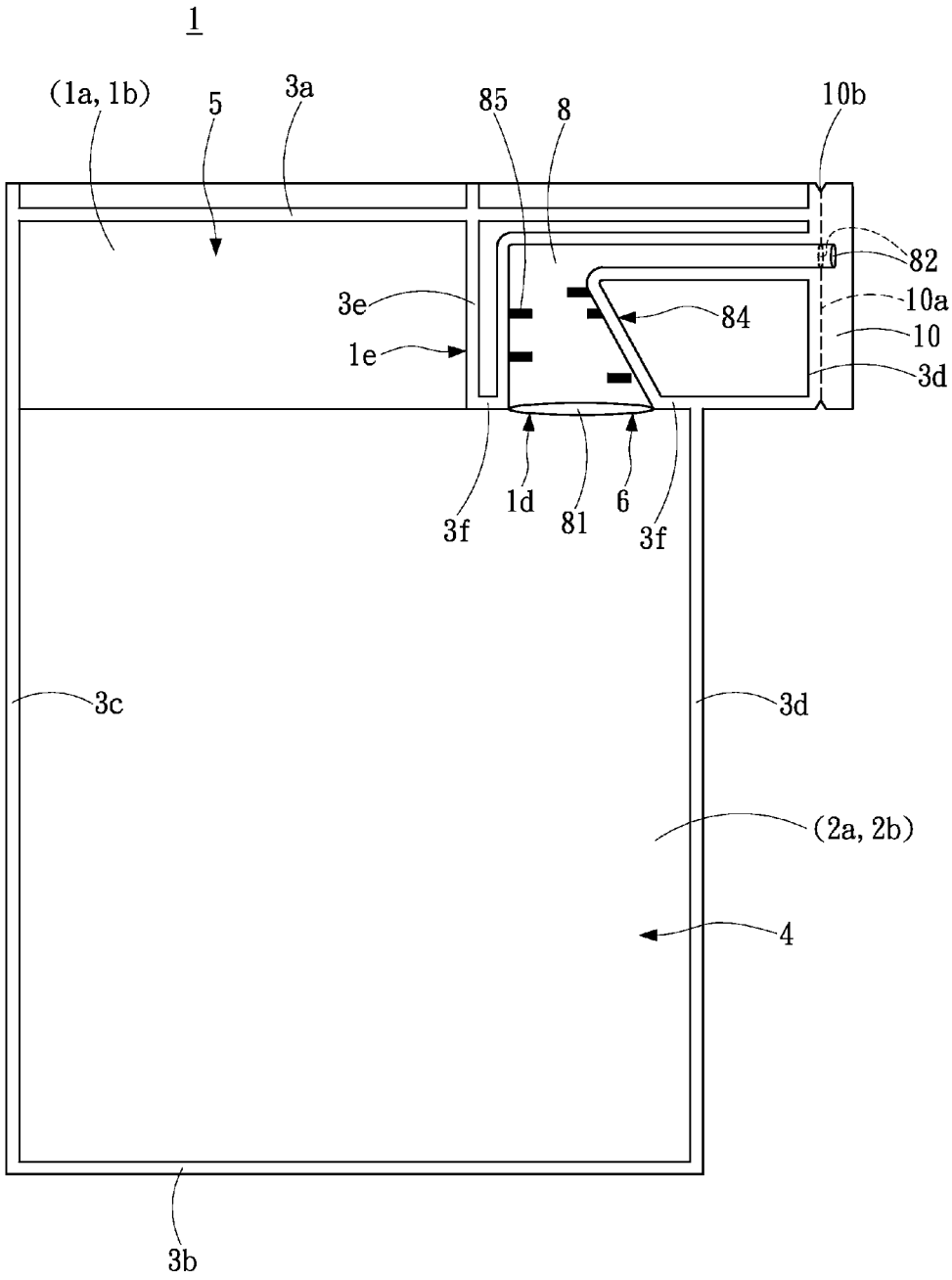
FIG. 6 is a schematic view of a third preferred embodiment of the present invention.

With reference to FIG. 6 for an automatic liquid stop bag with a bending portion according to a third preferred embodiment of the present invention, the major difference between the first preferred embodiment and this preferred embodiment resides on that the structures of the two inner films 1*a*, 1*b*. In this preferred embodiment, a side of the two inner films 1*a*, 1*b* is protruded from the two outer films 2*a*, 2*b* and exposed from the two outer films 2*a*, 2*b*, and the outlet 82 of the discharge channel 8 is formed outside the two outer films 2*a*, 2*b*.

Figure 7:
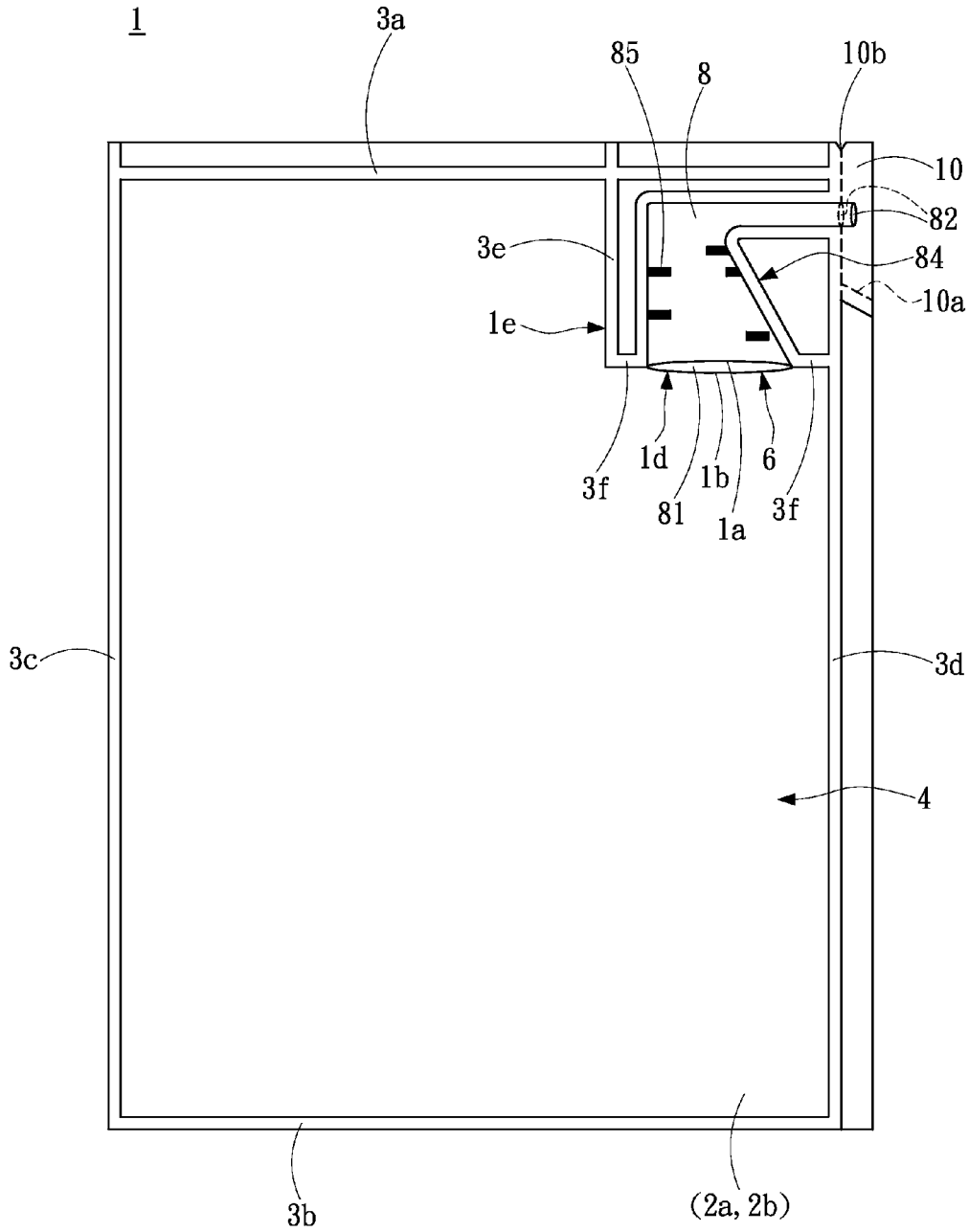
FIG. 7 is a schematic view of a fourth preferred embodiment of the present invention.

With reference to FIG. 7 for an automatic liquid stop bag with a bending portion in accordance with the fourth preferred embodiment of the present invention, the major difference between the first preferred embodiment and this preferred embodiment resides on the structures of the two inner films 1*a*, 1*b*. In this preferred embodiment, the two inner films 1*a*, 1*b* are replaced by a shorter plate instead, and the small plate is comprised of the two inner films 1*a*, 1*b* and used to replace the foregoing horizontal or perpendicular two inner films 1*a*, 1*b* in the two outer films 2*a*, 2*b*. The small plate and the two outer films 2*a*, 2*b* are sealed by heat-seal lines 3*c*, 3*b*, 3*d* to form a bag 1. At a heat-sealed line 3*e*, a heat-sealed line on the second side le and a heat-sealed line 3*f*, an inlet 81 and an outlet 82 of a discharge channel 8, and internal sides of the inner film are not coupled with one another, and a bent portion 84 of the discharge channel 8, a railing 85 of the bent portion 84, and a dotted line 10*a* and a notch 10*b* at the hot-seal tear portion are formed. After the automatic liquid stop bag with a bending portion is filled and completed, the filling area 5 is sealed by the heat-sealed line 3*a*. When use, the notch 10*b* is torn, and the dotted line of the outer film is folded to expose the discharge channel outlet 82 to achieve the effects of squeezing the liquid out from the bag and releasing the automatic flow stop of the liquid. When the bag is toppled over, there is no external pressure, so that the inlet 81 of the discharge channel 8 cannot be opened, and the two inner films 1*a*, 1*b* at the bent portion in the discharge channel 8 are still attached with one another to define the sealed status, so that the liquid stored in the bag can be prevent from flowing out along the discharge channel.

The present invention not only allows users to adjust the flow of the liquid in the bag by pressure freely, but also achieves the effects of dropping the level of the liquid to produce a reaction force at the discharge channel 8 to attach the inner films at the bent portion 84 with each other, prevent external air from entering, and maintaining an insufficient air condition when the pressure is released. Without oxygen, the time for oxidizing any liquid food stored in the liquid bag can be extended to achieve a longer preserving time than that of the general bottles.

Figure 8:
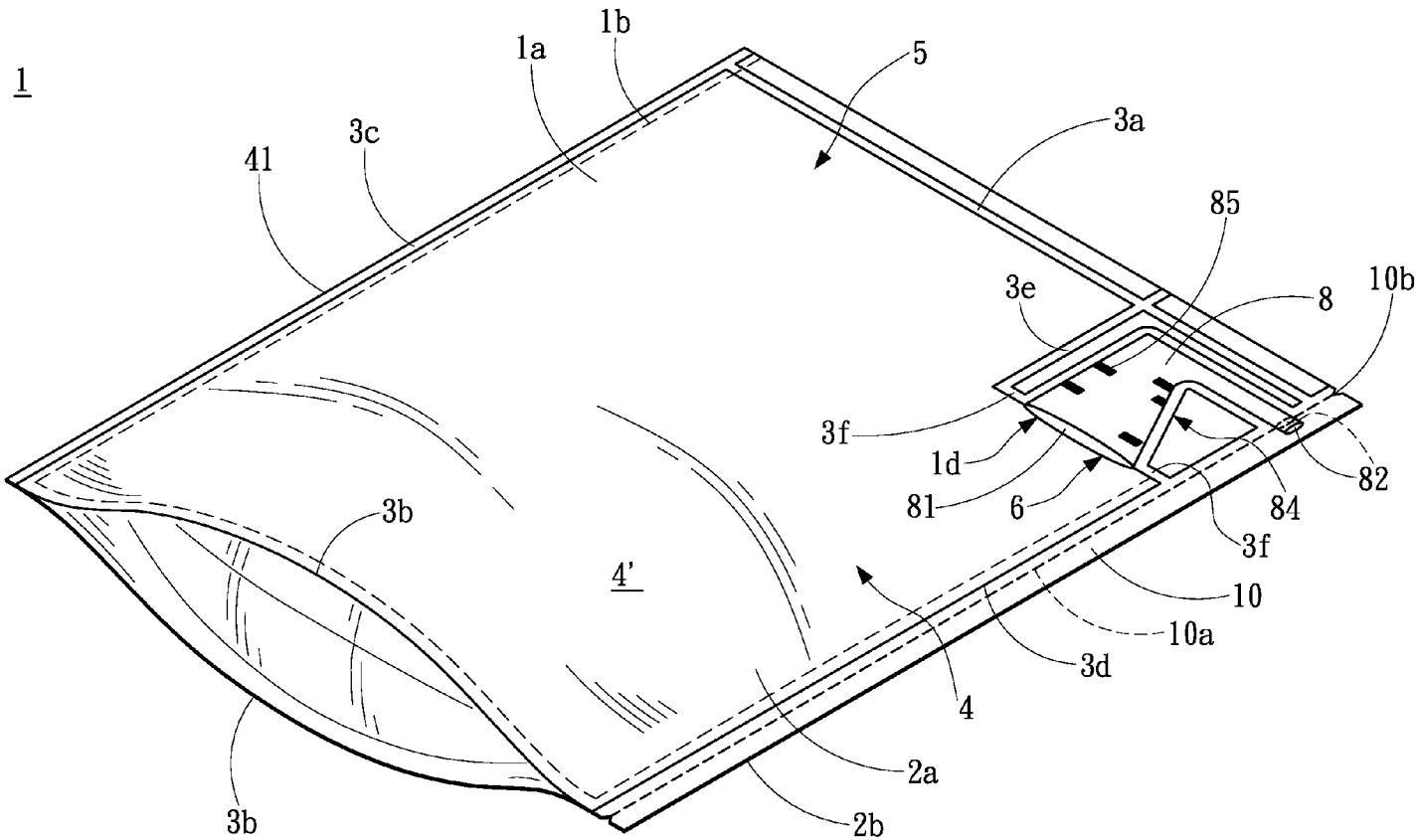
FIG. 8 is a schematic view of a fifth preferred embodiment of the present invention.

With reference to FIG. 8 for an automatic liquid stop bag with a bending portion in accordance with the fifth preferred embodiment of the present invention, the major difference between the first preferred embodiment and this preferred embodiment resides on that two inner films 1*a*, 1*b* are not installed in the two outer films 2*a*, 2*b* vertically or horizontally, and the two inner films 1*a*, 1*b* in the two outer films 2*a*, 2*b* are expanded to naturally form an inner storage bag 4' and combine upper sections of the two outer films 2*a*, 2*b* while maintaining lower sections of the two outer films 2*a*, 2*b* independent with each other. These four films at the upper sections are still attached with one another by the heat-seal lines 3*e*, 3*f* to define the filling area 5, the inner storage bag 4' and the discharge channel 8, and internal sides of the two inner films 1*a*, 1*b* are not coupled with each other, but each of the two inner films 1*a*, 1*b* is coupled to the inlet 81 and the outlet 82 of the two outer films 2*a*, 2*b*, the bent portion 84 in the discharge channel 8, and a railing 85 in the bent portion 84. To prevent external forces to force the liquid in the bag to rise and damage the heat-sealed line 3*f*, the heat seal area adjacent to the heat-sealed line 3*f* can be expanded and streamlined to form a dike to reduce air resistance as well as reducing the resistance for the liquid stored in the bag to flow out from the outlet 81.

In this preferred embodiment, the lower section of the outer film is separated from the inner film bag, and hot sealed to form an independent inner foldable bag or two independent sheets which can be used as the support area 41 of the inner bag 4' for the two inner films, such that the bag of the present invention can be placed at an upright position.

What is claimed is:

1. An automatic liquid stop bag with a bending portion, comprising:

two outer films;

two inner films, vertically overlapped with each other and formed between the two outer films, and having a stop plate pre-installed between the two inner films or a heat resisting material pre-coated between the two inner films;

a storage area, coupled to the two outer films, and formed between the two outer films, for storing a liquid;

a discharge channel, coupled to the two inner films and formed between the two inner films, and including at least one inlet, a bent portion and an outlet, and the two inner films being coupled to each outer film by heat sealing, and the bent portion being coupled to the inlet and the outlet; and a tear portion, disposed at the outlet of the discharge channel, and exposed from the outlet of a discharge channel after the tear portion is torn open;

characterized in that the level of the liquid is forced to rise, when the storage area is squeezed by an external force, so that the two outer films are pulled outward by the liquid to open the inlet of the discharge channel automatically, and the liquid flows along the bent portion of the discharge channel towards the outlet, and after the external force is released, a reaction sucking force refluxes the liquid to the storage area, such that the two inner films at the bent portion of the discharge channel are attached with each other by the reaction force to seal the discharge channel, and when the external pressure is released, the liquid returns from the bent portion to the storage area to produce the reaction force instantaneously to achieve an effect of sealing the discharge channel, and the two inner films at the bent portion are attached to each other to achieve an effect of enhancing the sealing effect.

2. The automatic liquid stop bag with a bending portion as recited in claim 1, further comprising:

a filling area, defined between the two outer films, and disposed on a side of the storage area, for filling the liquid to the storage area, and after the liquid is filled to the storage area, a sealing element is provided for coupling the two outer films and sealing the filling area; and a discharge area, defined between the two outer films, and disposed on the side of the storage area, and including the filling area in the discharge area.

3. The automatic liquid stop bag with a bending portion as recited in claim 2, wherein the sealing element is a heat-sealed line or a clip chain formed by heat sealing.

4. The automatic liquid stop bag with a bending portion as recited in claim 2, wherein a side of the two inner films is protruded from the discharge area, and the side of the two inner films is disposed at the filling area or the storage area.

5. The automatic liquid stop bag with a bending portion as recited in claim 1, wherein the bent portion is formed by heat sealing and coupling the two inner films.

6. The automatic liquid stop bag with a bending portion as recited in claim 5, wherein the discharge channel is formed by heat sealing and coupling the two inner films and the two outer films simultaneously.

7. The automatic liquid stop bag with a bending portion as recited in claim 5, wherein the discharge channel is formed by heat sealing and coupling the two inner films and one of the outer films simultaneously.

8. The automatic liquid stop bag with a bending portion as recited in claim 1, wherein the two inner films and the two outer films is heat sealed and coupled to form the inlet, the bent portion and the outlet of the discharge channel.

9. The automatic liquid stop bag with a bending portion as recited in claim 1, further comprising: a plurality of railings disposed in the discharge channel for preventing the liquid from refluxing from the discharge channel.

10. The automatic liquid stop bag with a bending portion as recited in claim 1, wherein a side of the two inner films is protruded from the two outer films and exposed from the two outer films, and the outlet of the discharge channel is formed outside the two outer films.

11. The automatic liquid stop bag with a bending portion as recited in claim 1, further comprising a support area formed by heat sealing and coupling the two outer films and provided for supporting the storage area.

12. The automatic liquid stop bag with a bending portion as recited in claim 1, further comprising an inner bag formed by heat sealing and coupling the two inner films.

13. The automatic liquid stop bag with a bending portion as recited in claim 1, wherein the discharge channel is formed between the two inner films by heat sealing and coupling the two inner films, and the storage area is formed between the two outer films by heat sealing and coupling the two outer films.

14. The automatic liquid stop bag with a bending portion as recited in claim 1, further comprising a stop plate pre-installed between the two inner films or the heat resisting material pre-coated between the two inner film, such that a position of the stop plate or the heat resisting material is not coupled during the heat sealing process to form an inlet and outlet.

* * * * *